US009909379B2

(12) United States Patent
Fraczek et al.

(10) Patent No.: US 9,909,379 B2
(45) **Date of Patent: *Mar. 6, 2018**

(54) LARGE-WIDTH/DIAMETER RISER SEGMENT LOWERABLE THROUGH A ROTARY OF A DRILLING RIG

(71) Applicant: AMERIFORGE GROUP INC., Houston, TX (US)

(72) Inventors: Justin Fraczek, Houston, TX (US); Roland Kennedy, Houston, TX (US); Randy Arthion, Houston, TX (US); Alex Gidman, Houston, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/596,781

(22) Filed: May 16, 2017

(65) Prior Publication Data

US 2017/0247970 A1 Aug. 31, 2017

Related U.S. Application Data

(63) Continuation of application No. 14/888,894, filed as application No. PCT/US2014/036317 on May 1, 2014.

(Continued)

(51) Int. Cl.
*E21B 17/01* (2006.01)
*E21B 33/02* (2006.01)
(Continued)

(52) U.S. Cl.
CPC ..... *E21B 33/02* (2013.01); *E21B 17/01* (2013.01); *E21B 17/042* (2013.01); *E21B 17/07* (2013.01); *E21B 7/12* (2013.01)

(58) Field of Classification Search
CPC ..... E21B 17/01; E21B 17/042; E21B 17/07; E21B 17/085; E21B 19/002; E21B 19/004; E21B 33/02; E21B 33/085
See application file for complete search history.

(56) References Cited

U.S. PATENT DOCUMENTS 4,183,562 A * 1/1980 Watkins ..... E21B 17/085 285/23
4,210,208 A * 7/1980 Shanks ..... E21B 17/01 166/352

(Continued)

FOREIGN PATENT DOCUMENTS

WO WO 86/02696 5/1986

OTHER PUBLICATIONS

Extended European Search Report issued in Application No. 14791006, dated Apr. 11, 2017.

(Continued)

*Primary Examiner* — Matthew R Buck
(74) *Attorney, Agent, or Firm* — Norton Rose Fulbright US LLP

(57) ABSTRACT

This disclosure includes auxiliary-line riser segment assemblies (e.g., with isolation units) that are suitable for managed pressure drilling (MPD) and that can be lowered (e.g., when connected to other riser segment assemblies) through a rotary of a drilling rig. Some embodiments are configured to have portions of the auxiliary lines connected (e.g., without welding) below the rotary.

26 Claims, 11 Drawing Sheets

Related U.S. Application Data

(60) Provisional application No. 61/819,210, filed on May 3, 2013.

(51) Int. Cl.

| | |
|---|---|
| ***E21B 17/07*** | (2006.01) |
| ***E21B 17/042*** | (2006.01) |
| *E21B 7/12* | (2006.01) |

(56) References Cited

U.S. PATENT DOCUMENTS

| | | | | |
|---|---|---|---|---|
| 4,987,956 | A * | 1/1991 | Hansen | E21B 29/08 166/340 |
| 8,127,854 | B2 | 3/2012 | Haheim | 166/367 |
| 8,413,724 | B2 * | 4/2013 | Carbaugh | E21B 17/085 166/344 |
| 8,528,647 | B2 * | 9/2013 | Guesnon | E21B 17/085 166/338 |
| 8,783,359 | B2 * | 7/2014 | Reed | E21B 21/06 166/267 |
| 9,074,425 | B2 * | 7/2015 | Feasey | E21B 21/08 |
| 9,109,420 | B2 * | 8/2015 | Tindle | E21B 33/035 |
| 2009/0260831 | A1 | 10/2009 | Moksvold | 166/350 |
| 2010/0300699 | A1 * | 12/2010 | Papon | E21B 17/01 166/367 |
| 2011/0017466 | A1 * | 1/2011 | Averbuch | E21B 17/085 166/345 |
| 2011/0073315 | A1 | 3/2011 | Guesnon et al. | 166/367 |
| 2011/0209876 | A1 | 9/2011 | Reed et al. | 166/345 |
| 2011/0225789 | A1 | 9/2011 | Darnell | 29/428 |
| 2012/0037377 | A1 * | 2/2012 | Walker | E21B 17/01 166/345 |
| 2012/0055677 | A1 | 3/2012 | Boyd | 166/350 |
| 2012/0312544 | A1 * | 12/2012 | Tavner | E21B 17/085 166/367 |
| 2013/0043036 | A1 | 2/2013 | Kotrla et al. | 166/345 |
| 2016/0076312 | A1 * | 3/2016 | Fraczek | E21B 19/002 166/367 |

OTHER PUBLICATIONS

Frink, "Managed pressure drilling—what's in a name?" *Drilling Contractor*, Mar./Apr. 2006, pp. 36-39.

International Search Report and Written Opinion issued in PCT/US2014/036317, dated Sep. 4, 2014.

Partial European Search Report issued in Application No. 14791006, dated Dec. 23, 2016.

* cited by examiner

LARGE-WIDTH/DIAMETER RISER SEGMENT LOWERABLE THROUGH A ROTARY OF A DRILLING RIG

CROSS-REFERENCE TO RELATED APPLICATIONS

This application is a continuation of U.S. Ser. No. 14/888,894, filed Nov. 3, 2015, which is a national phase application under 35. U.S. C. § 371 of International Application No. PCT/US2014/0036317, filed May 1, 2014, which claims priority to U.S. Provisional Patent Application No. 61/819,210, filed May 3, 2013, each of which are incorporated by reference in their entireties.

FIELD OF INVENTION

The invention relates generally to riser assemblies suitable for offshore drilling and, more particularly, but not by way of limitation, to riser assemblies that can be passed through a rotary of a drilling rig and have auxiliary lines assembled below the rotary.

BACKGROUND

Offshore drilling operations have been undertaken for many years. Traditionally, pressure within a drill string and riser pipe have been governed by the density of drilling mud alone. More recently, attempts have been made to control the pressure within a drill string and riser pipe using methods and characteristics in addition to the density of drilling mud. Such attempts may be referred to in the art as managed pressure drilling (MPD). See, e.g., Frink, *Managed pressure drilling—what's in a name?*, Drilling Contractor, March/April 2006, pp. 36-39.

SUMMARY

MPD techniques generally require additional or different riser components relative to risers used in conventional drilling techniques. These new or different components may be larger than those used in conventional techniques. For example, riser segments used for MPD techniques may utilize large components that force auxiliary lines to be routed around those components, which can increase the overall diameter or transverse dimensions of riser segments relative to riser segments used in conventional drilling techniques. However, numerous drilling rigs are already in existence, and it is generally not economical to retrofit those existing drilling rigs to fit larger-diameter riser segments.

Currently, MPD riser segment assemblies and/or components with an overall diameter or other transverse dimension that is too large to fit through a rotary or rotary table of a drilling rig must be loaded onto the rig below the deck (e.g., on the mezzanine level) and moved laterally into position to be coupled to the riser stack below the rotary. This movement of oversize components is often more difficult than vertically lowering equipment through the rotary from above (e.g., with a crane). At least some of the present embodiments can address this issue for various MPD components by allowing a riser segment to be lowered through a rotary and having auxiliary lines attached to the riser segment below the rotary. Such auxiliary lines are much smaller and easier to transport on the mezzanine level than an overall riser segment and permit a riser segment to be coupled to other riser segments above the rotary to permit multiple coupled riser segments to be simultaneously lowered through a rotary. Other embodiments include auxiliary lines that remain coupled to the riser segment, but that run through a portion of a housing of a large-diameter and/or large-transverse-dimension component of the riser segment such that the auxiliary lines will fit through a rotary of a drilling rig.

Some embodiments of the present riser segment assemblies comprise: a main tube; two flanges each coupled to a different end of the main tube (each flange comprising: a mating face configured to mate with a flange of an adjacent riser segment; a central lumen configured to be in fluid communication with the main tube; and at least one auxiliary hole configured to receive an auxiliary line); and an auxiliary line configured to extend between the two flanges, the auxiliary line comprising: a first connector coupled to the first flange; a second connector coupled to the second flange; and a variable-length removable body having a first end configured to be connected to the first connector, and a second end configured to be connected to the second connector. In some embodiments, the first and second ends of the removable body are configured to be connected to the first and second connectors without welding. In some embodiments, the removable body includes a third connector configured to be connected to the first connector, and a fourth connector configured to be connected to the second connector. In some embodiments, the removable body includes a telescoping joint. In some embodiments, the telescoping joint includes a male portion and a female portion configured to slidably receive the male portion. In some embodiments, the removable body includes a medial portion that is laterally offset from the first and second ends of the removable body. In some embodiments, the main tube includes an isolation unit configured to substantially seal an annulus in the main tube if a drill string is disposed in the main tube, the medial portion of the removable body configured to extend around the isolation unit.

Some embodiments of the present riser segment assemblies further comprise: a plurality of auxiliary lines configured to extend between the two flanges, each of the plurality of auxiliary lines comprising: a first connector coupled to the first flange; a second connector coupled to the second flange; and a variable-length removable body having a first end configured to be connected to the first connector, and a second end configured to be connected to the second connector. In some embodiments, the first and second connectors fit within a circle having a diameter no larger than 150% of a maximum transverse dimension of either flange. In some embodiments, the first and second connectors fit within a circle having a diameter no larger than 120% of the maximum transverse dimension of either flange. In some embodiments, the first and second connectors fit within a circle having a diameter no larger than the maximum transverse dimension of either flange. In some embodiments, the plurality of auxiliary lines includes at least one booster line and at least one choke/kill line.

Some embodiments of the present riser segment assemblies comprise: a main tube having an isolation unit configured to seal an annulus in the main tube if a drill string is disposed in the main tube, the isolation unit having a housing with a maximum transverse dimension and a passage configured to receive an auxiliary line within the maximum transverse dimension; two flanges each coupled to a different end of the main tube (each flange comprising: a mating face configured to mate with a flange of an adjacent riser segment; a central lumen configured to be in fluid communication with the main tube; and at least one auxiliary hole configured to receive an auxiliary line); and an auxiliary line having a first end coupled to the first flange, a second end coupled to the second flange, and a medial portion laterally offset from the first and second ends and disposed in the passage of the isolation unit. In some embodiments, the body of the isolation unit has a circular cross section and the maximum transverse dimension is the diameter of the circular cross-section. In some embodiments, the auxiliary line comprises: a first connector coupled to the first flange; a second connector coupled to the second flange; and a body having a first end configured to be slidably received in the first connector, and a second end configured to be slidably receive the second connector.

In some embodiments of the present riser segment assemblies, the housing of the isolation unit includes a plurality of passages each configured to receive an auxiliary line within the maximum transverse dimension, and the riser segment assembly further comprises: a plurality of auxiliary lines each having a first end coupled to the first flange, a second end coupled to the second flange, and a medial portion laterally offset from the first and second ends and disposed in one of the plurality of passages of the isolation unit.

Some embodiments of the present methods comprise: lowering an embodiment of the present riser segment assemblies through a rotary of a drilling rig.

Some embodiments of the present methods comprise: lowering a riser segment assembly through a rotary of a drilling rig, the riser segment assembly comprising: a main tube; two flanges each coupled to a different end of the main tube (each flange comprising: a mating face configured to mate with a flange of an adjacent riser segment; a central lumen configured to be in fluid communication with the main tube; and at least one auxiliary hole configured to receive an auxiliary line); a first connector coupled to the first flange; and a second connector coupled to the second flange. Some embodiments further comprise: connecting, below the rotary, an auxiliary line to the first and second connectors without welding. In some embodiments, the auxiliary line includes a variable-length body having a first end configured to be connected to the first connector, and a second end configured to be connected to the second connector. In some embodiments, the auxiliary line includes a telescoping joint. In some embodiments, the telescoping joint includes a male portion and a female portion configured to slidably receive the male portion. In some embodiments, the auxiliary line includes a medial portion that is laterally offset from the first and second ends of the removable body. In some embodiments, the riser segment assembly is coupled to other riser segments before it is lowered through the rotary.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, an apparatus that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale for at least the embodiments shown.

DESCRIPTION OF ILLUSTRATIVE EMBODIMENTS

Figure 1:
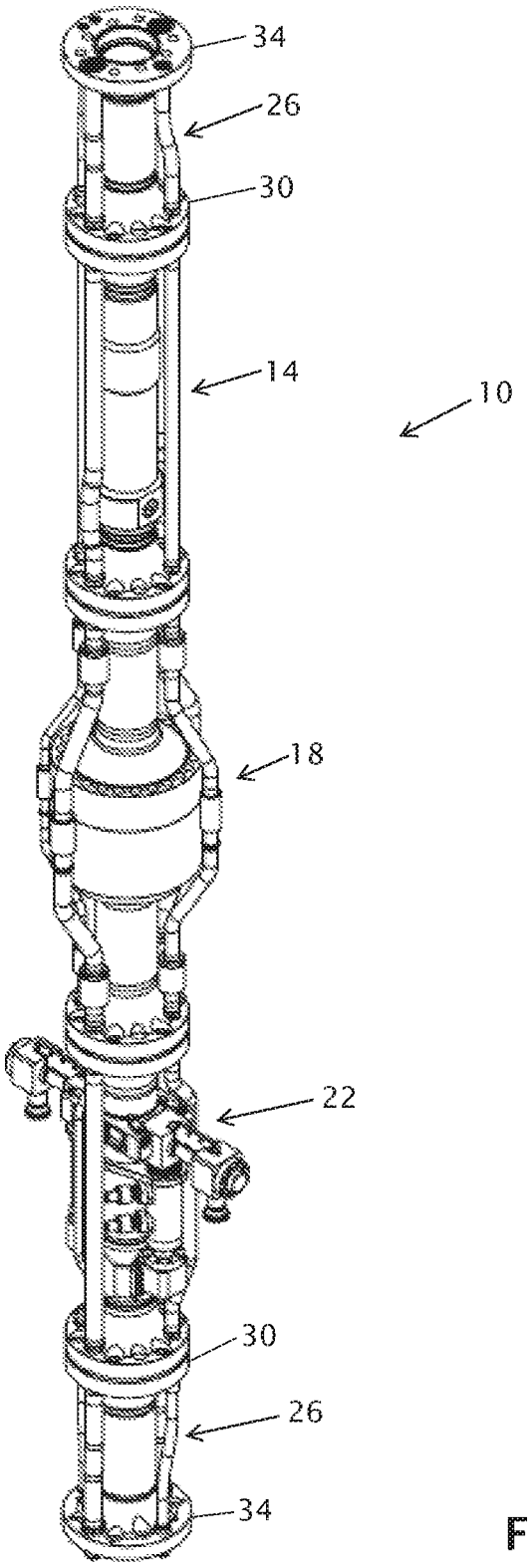
FIG. 1 depicts a perspective view of a riser stack including an embodiment of the present riser segment assemblies.

Referring now to the drawings, and more particularly to FIG. 1, shown there and designated by the reference numeral 10 is one embodiment of a riser assembly or stack that includes multiple riser segments. In the embodiment shown, assembly 10 includes a rotating control device (RCD) body segment 14, an isolation unit segment 18, a flow spool segment 22, and two crossover segments 26 (one at either end of assembly 10). In this embodiment, crossover segments 26 each has a first type of flange 30 at an inner end (facing segments 14, 18, 22) a second type of flange 34 at an outer end (facing away from segments 14, 18, 22). Flanges 30 can, for example, include a proprietary flange design and flanges 34 can, for example, include a generic flange design, such that crossover segments 26 can act as adapters to couple segments 14, 18, 22 to generic riser segments with others types of flanges. Crossover segments 26 are optional, and may be omitted where riser segments above and below segments 14, 18, 22 have the same type of flanges as segments 14, 18, 22.

FIGS. 2-8 show the depicted embodiment of isolation unit segment assembly 18 in more detail. In this embodiment, assembly 18 comprises: a main tube 100 having a first end 104 and a second end 108; and two flanges 112*a* and 112*b* each coupled to a different end of the main tube. In this embodiment, each flange 112*a*, 112*b* includes a mating face 116 configured to mate with a flange of an adjacent riser segment (e.g., via bolts extending through bolt holes 118); a central lumen 120 configured to be in fluid communication with main tube 100; and at least one auxiliary hole 124 configured to receive an auxiliary line 128. In the embodiment shown, assembly 18 includes a plurality of auxiliary lines 128 and each flange 112*a*, 112*b* includes a plurality of auxiliary holes 124, each configured to receive a different one of the auxiliary lines. One example of a flange design (for flanges 112*a* and 112*b*) that is suitable for at least some embodiments is described in U.S. Provisional Application No. 61/791,222, filed Mar. 15, 2013, which is incorporated by reference in its entirety. In the embodiment shown, each auxiliary line comprises a first connector 132 coupled to first flange 112*a* (e.g., via conduit 134), a second connector 136 coupled to second flange 112*b* (e.g., via conduit 138), and a variable length removable body 140 having a first end 144 configured to be connected to first connector 132 (e.g., without welding), and a second end 148 configured to be connected to second connector 136 (e.g., without welding).

In the embodiment shown, removable body 140 includes a third connector 152 configured to be connected to first connector 132 (e.g., without welding), and a fourth connector 156 configured to be connected to second connector 136 (e.g., without welding). In this embodiment, and as shown in more detail in FIG. 5B, each pair of connectors (132 and 152, 136 and 156) forms a modified hammer union, as are known in the plumbing arts. More particularly, in the embodiment shown, connector 132 includes a collar 160 slidably disposed on conduit 134 and having internal threads 164 near its distal end 168, and conduit 134 includes an enlarged female end 172 with a recess 176 sized to receive first end 144 of body 140. In this embodiment, body 140 also includes an enlarged shoulder 180 near first end 144, as shown, and shoulder 180 includes external threads 184 corresponding to internal threads 164 on collar 160. In this configuration, connectors 132 and 152 are connected by inserting first end 144 of body 140 into receptacle 176 in end 172 of conduit 134 until shoulder 180 contacts end 172, and then collar 160 is slid along conduit 134 until threads 164 engage threads 184, at which point collar 160 is rotated relative to conduit 134 and body 140 to tightly connect the two. In this embodiment, conduit 134 also includes grooves 188 surrounding recess 176 to receive sealing and/or lubricating components (e.g., O-rings, rigid washers, grease, and/or the like) to facilitate insertion of first end 144 into recess 176 and/or improve the seal between first end 144 and end 172*b*. In this embodiment, connector 152 serves as a "male" component of the connection, and connector 132 serves as a "female" component of the connection. The connector pair with connectors 136 and 156 is similar, with the exception that connector 136 serves as the "male" component (similar to connector 152), and connector 156 serves as the "female" component (similar to connector 132).

In the embodiment shown, removable body 140 includes a telescoping joint 192. In this embodiment, and as shown in more detail in FIG. 5A, joint 192 includes a male portion 196 and a female portion 200 configured to slidably receive the male portion. In the embodiment shown, body 140 includes a first portion 140*a* and a second portion 140*b*. In this embodiment, first portion 140*a* includes an enlarged female end 204 having a recess 208 sized to receive end 212 of second portion 140*b*, which includes a shoulder 216 that may be positioned to at least partially limit the travel of second portion 140*b* relative to first portion 140*a*. In this embodiment, female portion 200 also includes grooves 220 surrounding recess 208 to receive sealing and/or lubricating components (e.g., O-rings, rigid washers, grease, and/or the like) to facilitate insertion of end 212 into recess 208 and/or improve the seal between first portion 140*a* and second portion 140*b*. In the embodiment shown, telescoping joint 192 permits shortening and lengthening removable body 140 to facilitate removing and adding body 140 to assembly 18, as described in more detail below.

In the embodiment shown, body 140 includes a medial portion 224 that is laterally offset from first and second ends 144 and 148, as shown. A lateral offset can accommodate a protruding or otherwise larger section of main tube 100. For example, in the embodiment shown, main tube 100 includes an isolation unit 228 configured to substantially seal an annulus in main tube 100 if a drill string is disposed in main tube 100. As a result, the outer diameter of main tube 100 in the region of isolation unit 228 is greater than the outer diameter of flanges 112*a* and 112*b*. To accommodate this larger dimension, medial portion 224 is configured to extend around isolation unit 228; for example, medial portion 224 of body 140 is laterally offset relative to its ends to permit body 140 (and thereby auxiliary line 128) to extend around isolation unit 228.

Isolation unit 228 may, for example, be similar in structure to a spherical or annular (or other type of) blowout preventer (BOP). In this embodiment, isolation unit 228 has an outer diameter of 59 inches and will, by itself, fit through a 60.5-inch rotary (sometimes referred to in the art as a 60-inch rotary) of a drilling rig. Other embodiments of isolation unit 228 can have a different outer diameter (e.g., between 50 and 59 inches, less than 50 inches, greater than 59 inches). For example, some rotaries have diameters greater than 60.5 inches (e.g., 75 inches). Isolation unit 228 is included as an example of a component that may be included in the present riser segment assemblies; other embodiment may not include an isolation unit and/or may include other types of devices (e.g., a rotating control device), other types of BOPs, and/or the like). Medial portion 224 of body 140 can be configured to accommodate the dimension of other types of devices as well. In other embodiment, body 140 may be axially aligned along its length (may not include a laterally offset portion).

Figure 2:
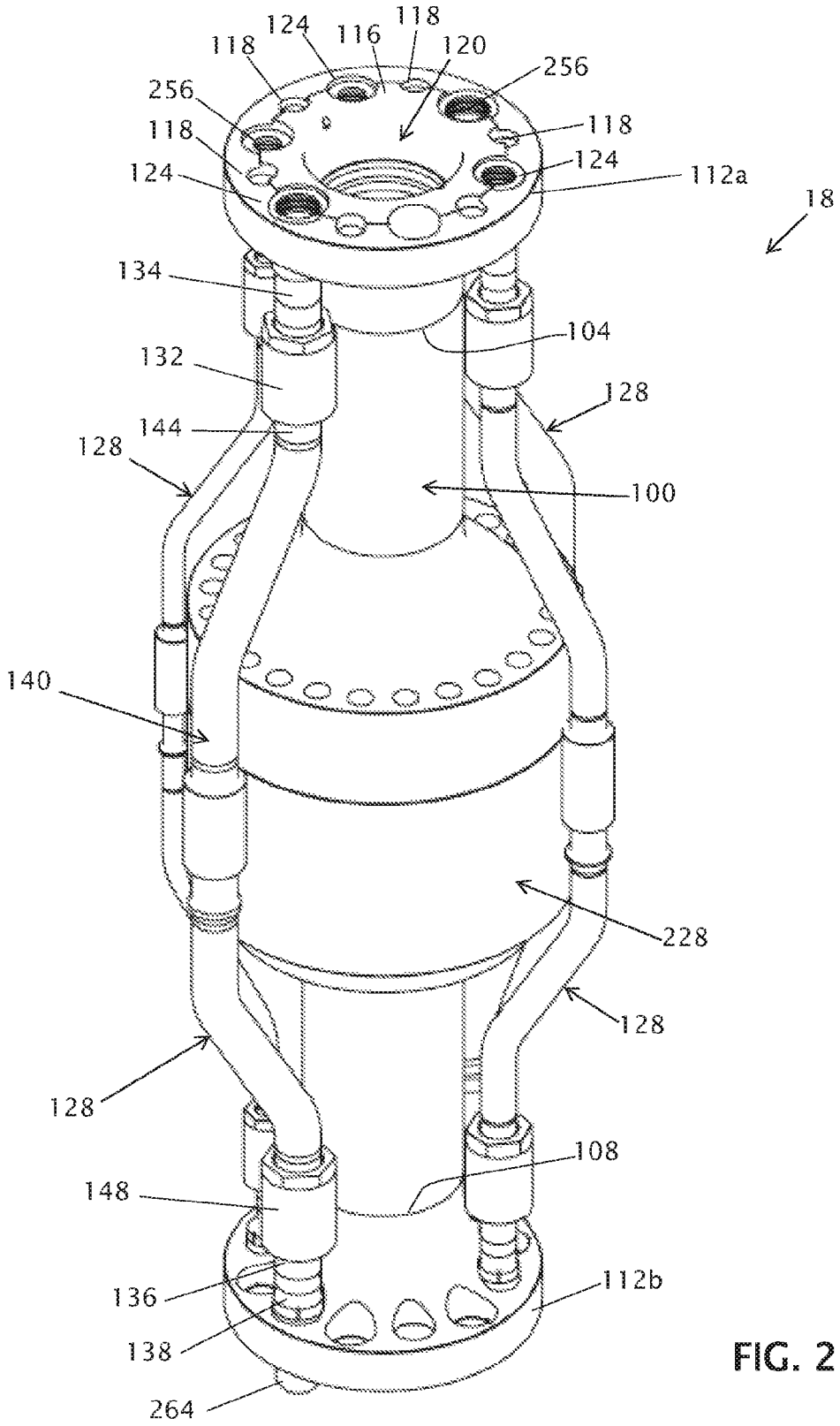
FIG. 2 depicts perspective view of an embodiment of the present riser segment assemblies that includes an isolation unit.
Figure 3:
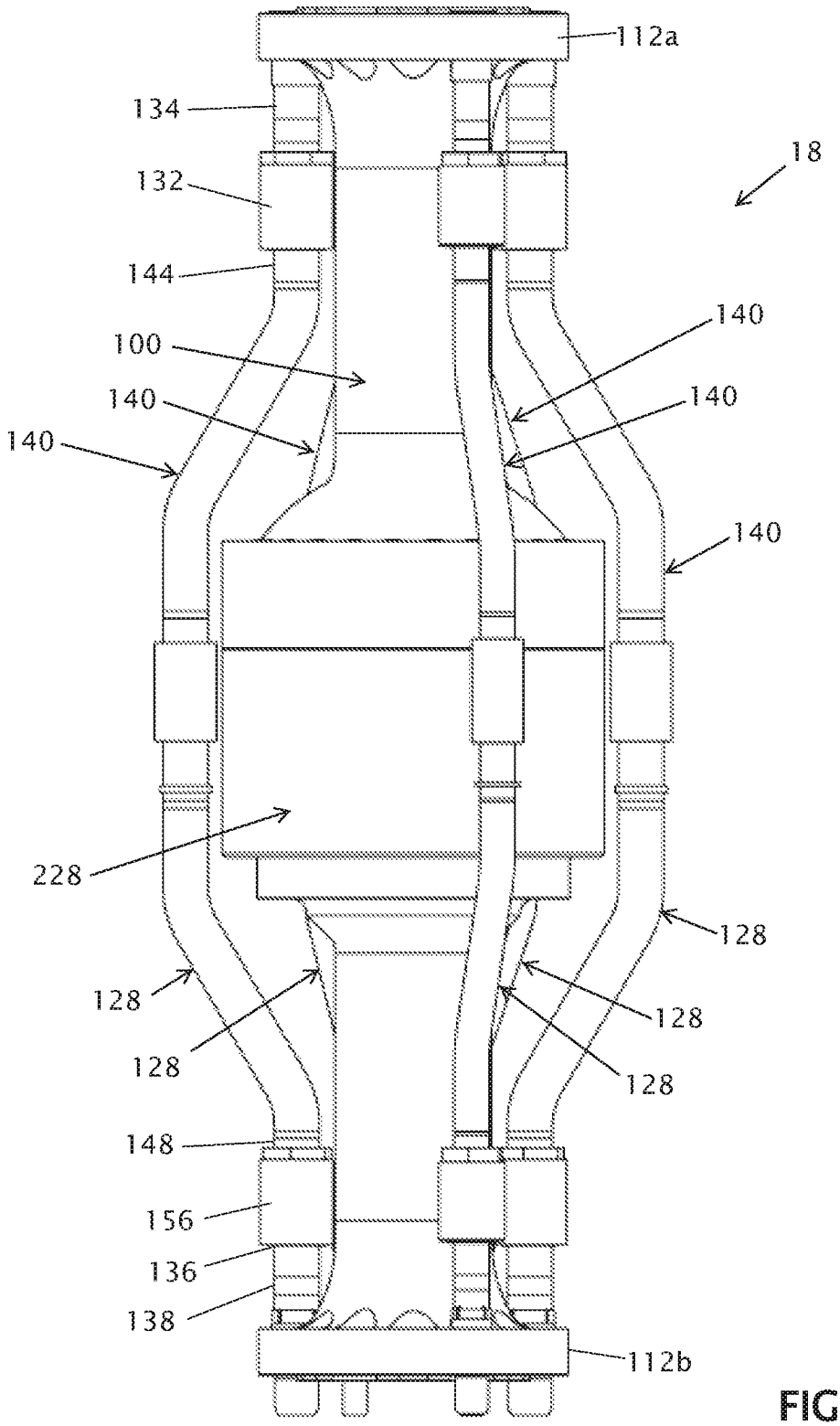
FIG. 3 depicts a side view of the riser segment assembly of FIG. 2.
Figure 6:
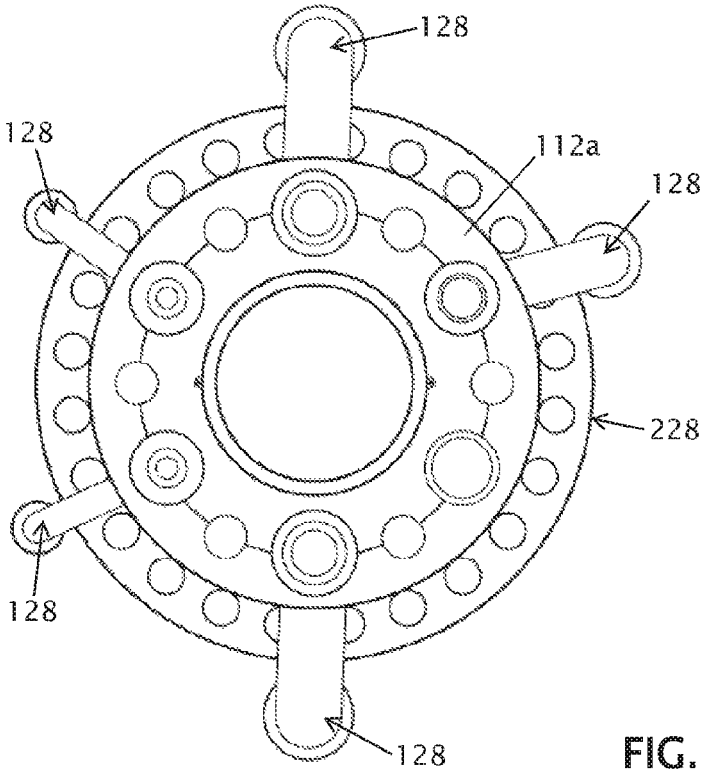
FIG. 6 depicts a top view of the riser segment assembly of FIG. 2.

While only one auxiliary line 128 is described in detail, it should be understood that, at least in the depicted embodiment, all of the plurality of auxiliary lines 128 are similar in construction, and differ only in the respective diameters of their tubing (e.g., removable bodies 140). For example, the plurality of auxiliary lines can include at least one booster line (e.g., having a relatively smaller diameter) and at least one choke/kill line (e.g., having a relatively larger diameter). In this embodiment, and as shown in detail in FIG. 6, the plurality of auxiliary lines 128 enlarge the overall diameter (or other maximum transverse dimension) of assembly 18. However, because bodies 140 of auxiliary lines 128 are removable, only connectors 132 and 152 (of auxiliary lines 128) need to stay within a size that will fit through the rotary. For example, as shown in FIG. 6, connectors 132 fit within the overall diameter of flange 112*a*. And as shown in FIG. 2, connectors 152 fit within the diameter of isolation unit 228 but extend slightly outside of the diameter of flange 112*b*. In other embodiments, connectors 132 and/or connectors 152 can fit within (have a maximum transverse dimension that is less than the diameter of) a circle (concentric with main tube 100) having a diameter no larger than 150% (e.g., no larger than 120%, or no larger than 100%) of a maximum transverse dimension of either flange.

Figure 7:
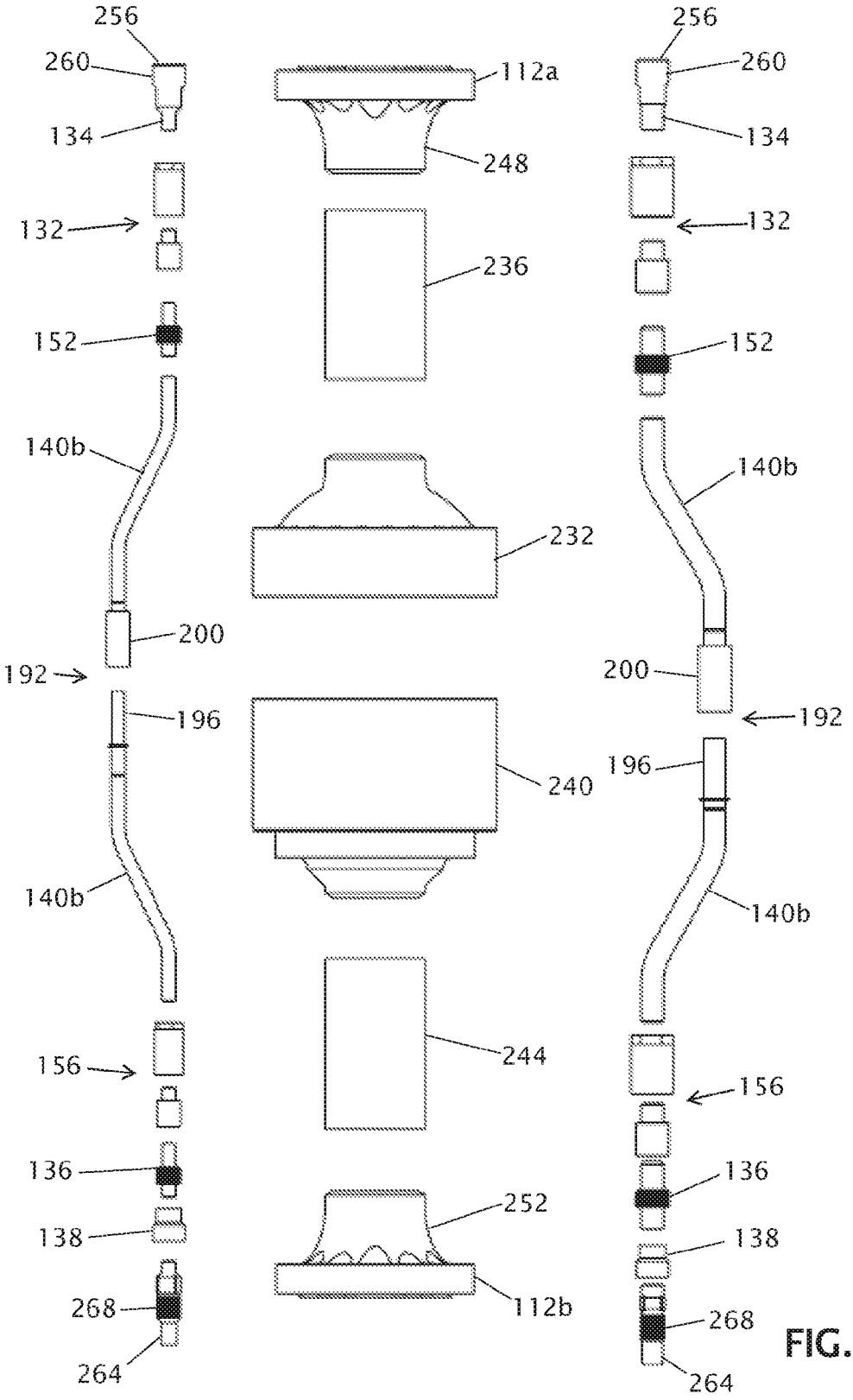
FIG. 7 depicts an exploded side view of the riser segment assembly of FIG. 2 with several auxiliary lines omitted for clarity.

FIG. 7 depicts an exploded view of assembly 18 illustrating one example of a method of manufacturing assembly 18. In the embodiment shown, isolation unit 228 includes a first housing member 232 welded to a first portion 236 of main tube 100, and a second housing member 240 welded to a second portion 244 of main tube 100. Portions 232 and 240 are also welded to neck portions 248 and 252 of flanges 112*a* and 112*b*, respectively, and housing members 232 and 240 can be connected to one another (e.g., via bolts). In the embodiment shown, conduit 134 extends from connector 132 to (e.g., and is welded to) a female fitting 256 sized to fit within the corresponding one of auxiliary holes 124 of flange 112*a*. Fitting 256 can be coupled to flange 112*a* via welds, threads, and/or the like (e.g., via external threads 260 on fitting 256 that correspond to internal threads of flange 112*a* in the corresponding auxiliary hole (124). Female fitting 256 is configured to slidably receive a corresponding male fitting in an adjacent riser segment to provide a connection between the corresponding auxiliary lines of adjacent riser segments. For example, conduit 138 extends from connector 136 (e.g., and is welded to) a male fitting 264 sized to fit within the corresponding one of auxiliary holes 124 in flange 112*b*. Male fitting 264 can be coupled to flange 112*b* via welds, threads, and/or the like (e.g., via external threads 268 on fitting 264 that correspond to internal threads of flange 112*b* in the corresponding auxiliary hole (124)). Male fitting 264 is configured to be slidably received in a corresponding female fitting (e.g., 256) of an adjacent riser segment to provide a connection between the corresponding auxiliary lines of adjacent riser segments. This configuration is similar to that of telescoping joint 192 in that the male fittings 264 slide into recesses 260 of female fittings (256) on an adjacent riser segment (e.g., flow spool segment 22 in FIG. 1) to automatically connect the auxiliary lines of the adjacent riser segments.

Figure 8:
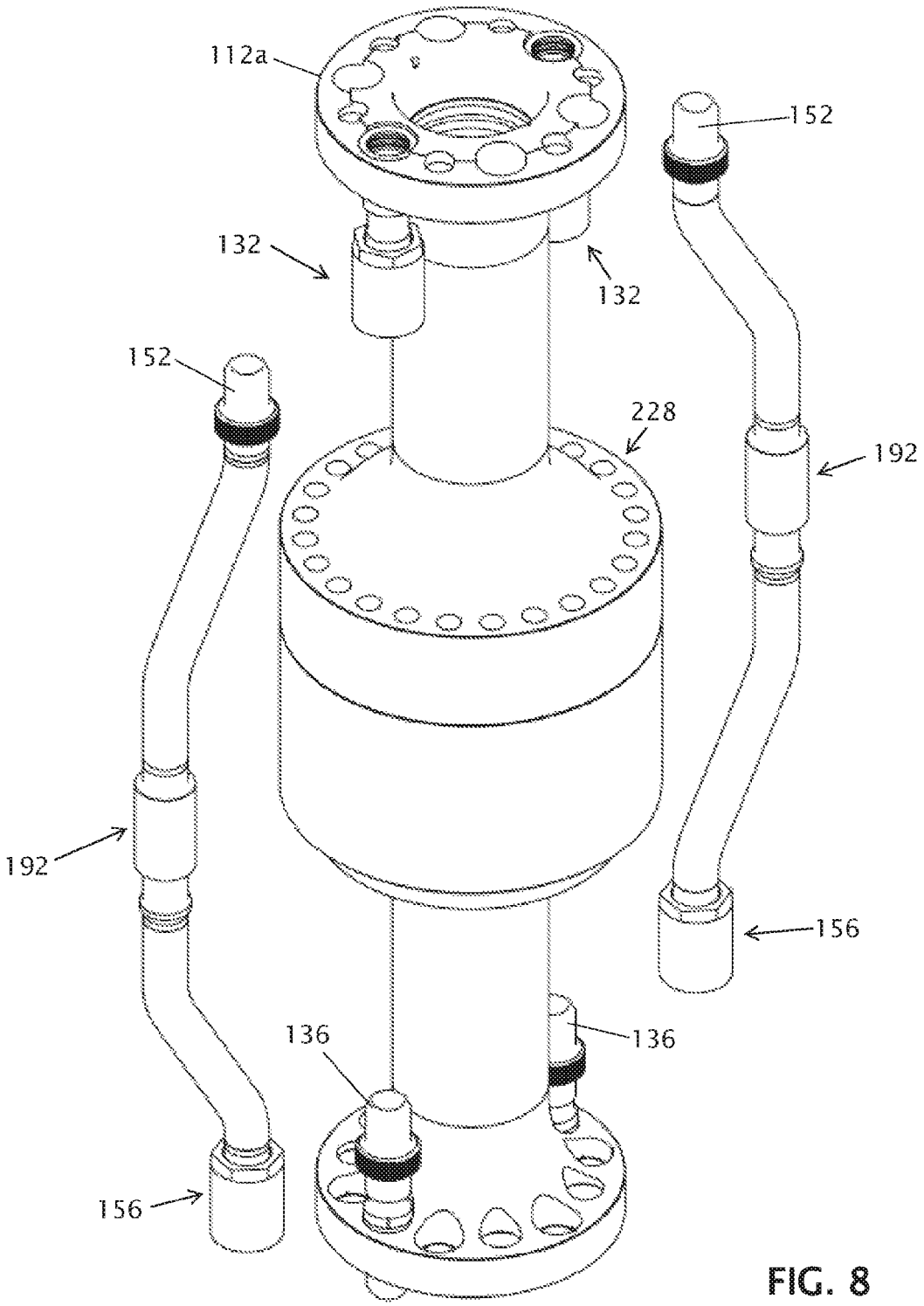
FIG. 8 depicts a partially disassembled perspective view of the riser segment assembly of FIG. 2 with several auxiliary lines omitted for clarity.
Figure 9:
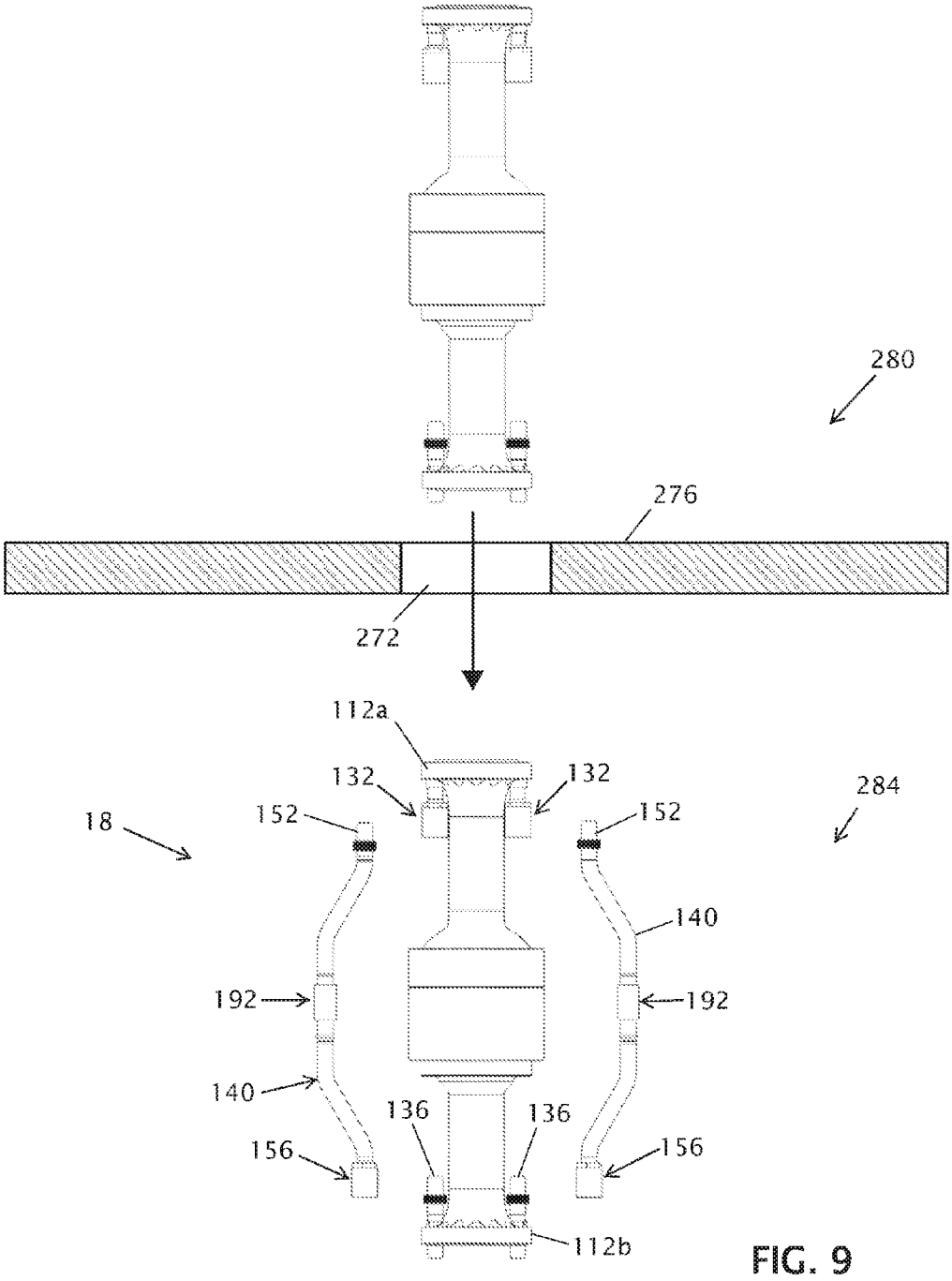
FIG. 9 depicts a side view of the riser segment assembly of FIG. 2 being lowered through a rotary and partially assembled (with several auxiliary lines omitted for clarity) below the rotary in accordance with some embodiments of the present methods.

FIG. 8 depicts assembly 18 in a partially disassembled state in which most of assembly 18 (all except removable bodies 140 of auxiliary lines 128 can be passed through a rotary of a drilling rig). In particular, connectors 152 and 156 of removable body 140 have been disconnected from connectors 132 and 136 at flanges 112*a* and 112*b*, respectively, and removable bodies 140 have been removed from the rest of assembly 18. As shown in FIG. 9, when assembly 18 is in this partially disassembled state, the majority of assembly 18 can be passed through a rotary 272 (e.g., in an upper deck 276) of a drilling rig 280, and removable bodies 140 of the auxiliary lines can be connected to connectors 132 and 136 (e.g., without welding) below rotary 272, such as, for example, by a person standing in a mezzanine level 284 of the drilling rig to complete installation of auxiliary lines 128 in assembly 18, as shown in FIGS. 1-4. In particular, in the embodiment shown, variable-length removable bodies 140 are each shortened to the shortest overall lengths by compressing telescoping joint 192, such that connectors 152 and 156 can be aligned with connectors 132 and 136, respectively. Once or as connectors 152 and 156 are aligned with connectors 132 and 136, respectively, body 140 can be elongated via telescoping joint 192 to fit connector 152 into connector 132, and to fit connector 136 into connector 156 such that the various connections can be secured.

Figure 10:
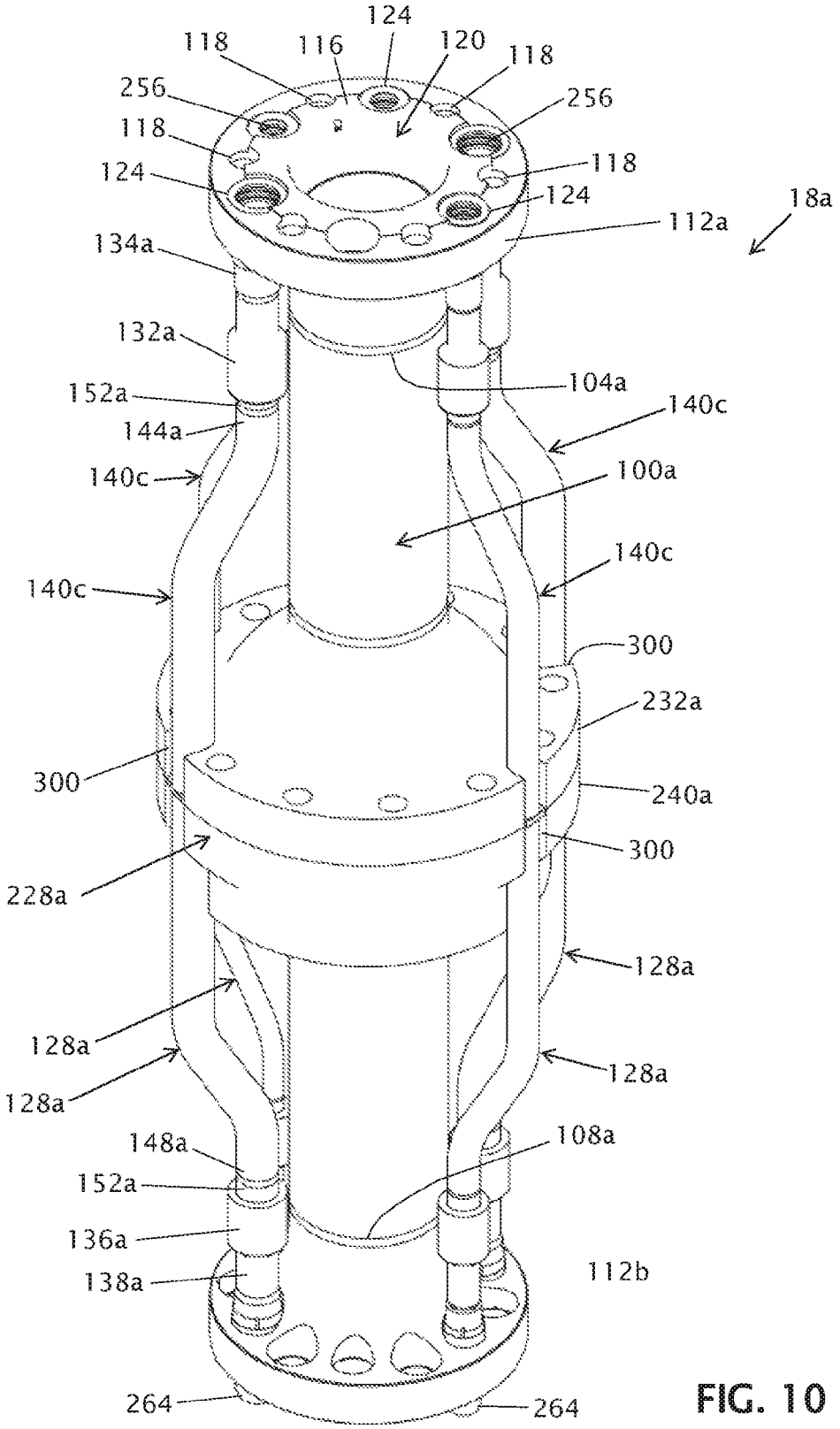
FIG. 10 depicts a perspective view of a second embodiment of the present riser segment assemblies that includes an isolation unit.
Figure 11:
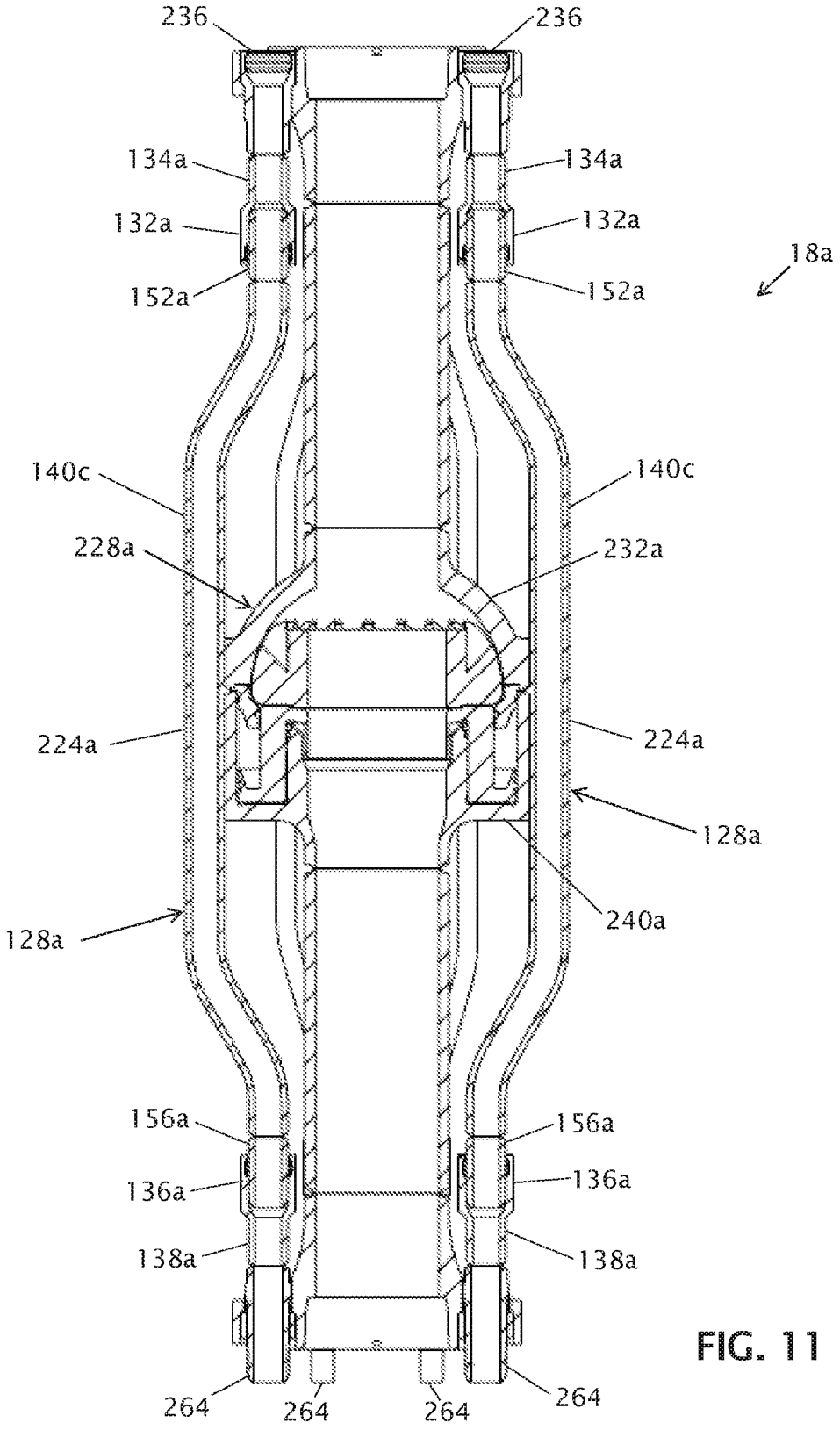
FIG. 11 depicts a side cross-sectional view of the riser segment assembly of FIG. 10.
Figure 12:
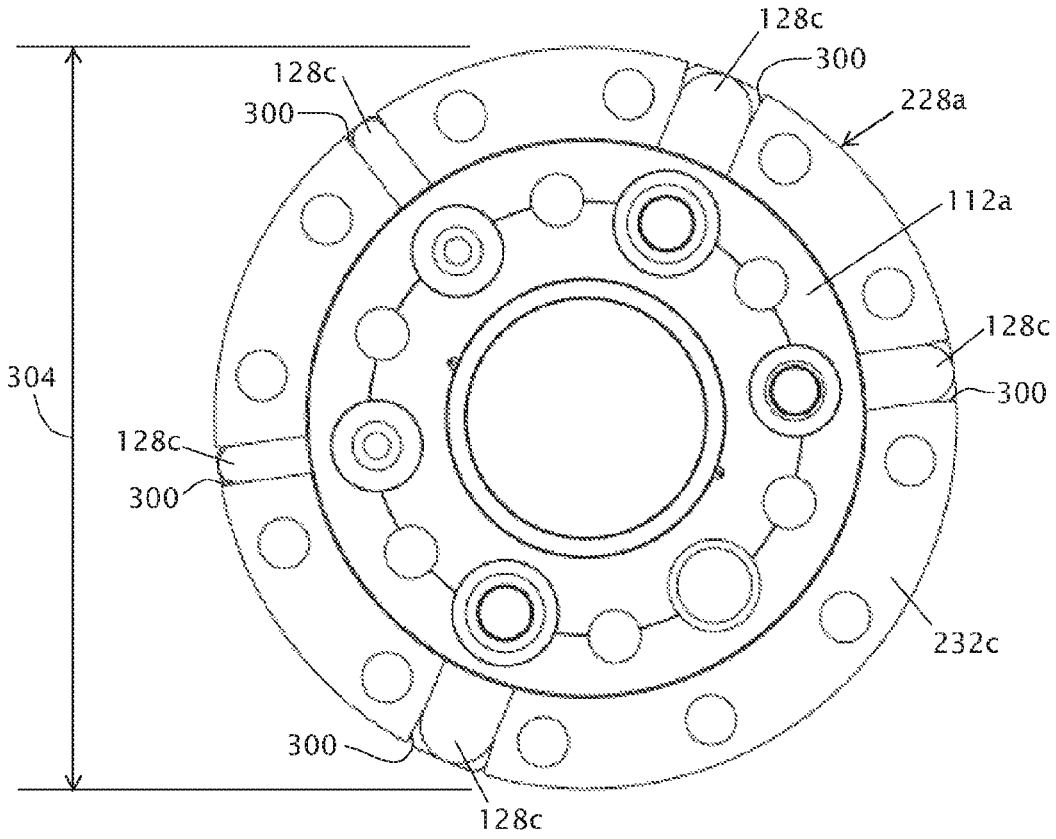
FIG. 12 depicts a top view of the riser segment assembly of FIG. 10.

FIGS. 10-12 depict a second embodiment 18*a* of an isolation unit riser segment assembly that can be included in assembly 10 of FIG. 1 (e.g., additional or alternative to isolation unit segment 18). Several features of assembly 18*a* are similar to corresponding features of assembly 18 and, as such, the differences are primarily described here. In this embodiment, assembly 18*a* comprises: a main tube 100*a* having a first end 104*a* and a second end 108*a*; and two flanges 112*a* and 112*b*, each coupled to a different end of the main tube. In the embodiment shown, flanges 112*a*, 112*b* are similar to flanges 112*a* and 112*b* of assembly 18 above. In this embodiment, each auxiliary line 128*a* comprises a first connector 132*a* coupled to first flange 112*a* (e.g., via conduit 134*a*), a second connector 136*a* coupled to second flange 112*b* (e.g., via conduit 138*a*), and a fixed-length body 140*c* having a first end 144*a* configured to be connected to first connector 132*a* (e.g., without welding), and a second end 148*a* configured to be connected to second connector 136*a* (e.g., without welding).

Figure 4:
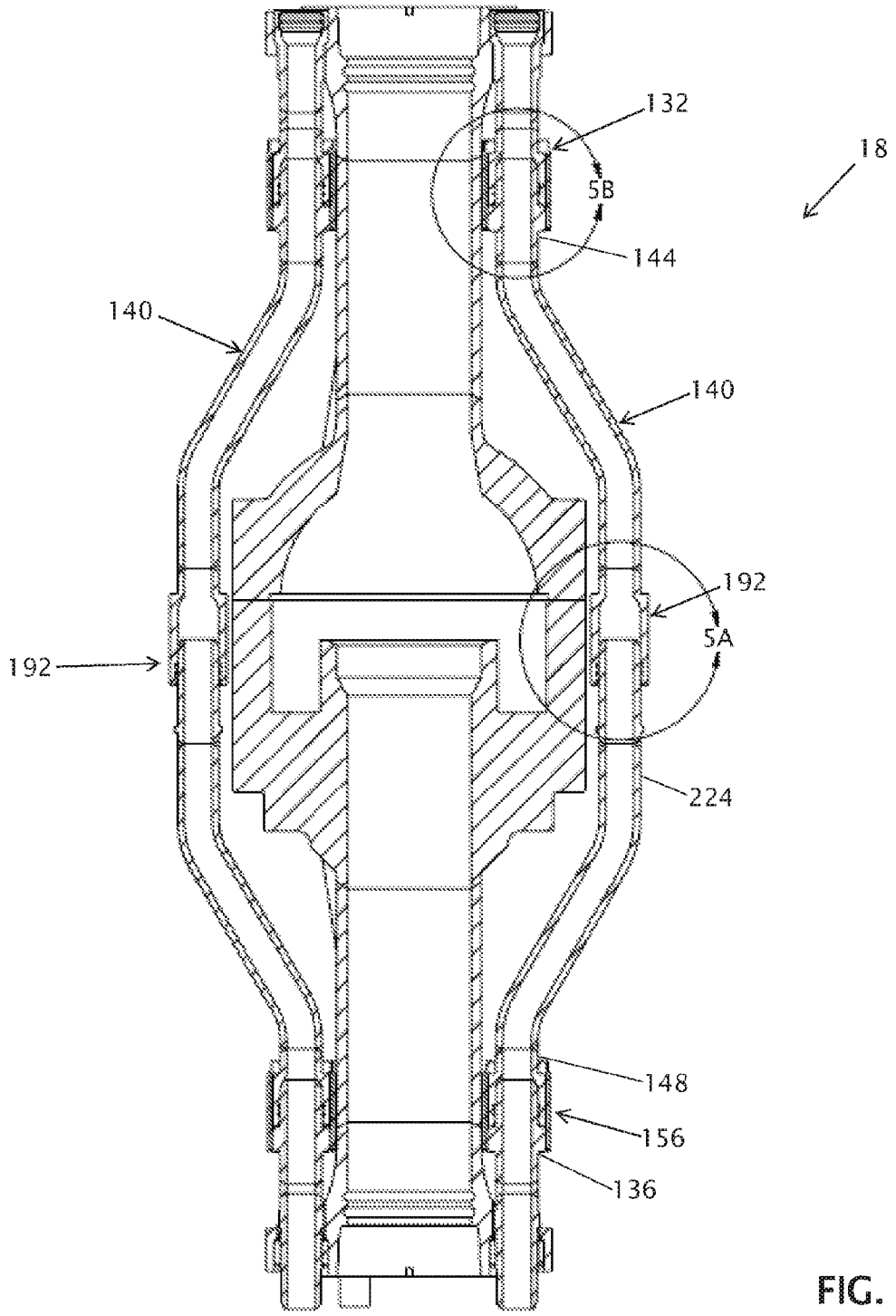
FIG. 4 depicts a cross-sectional view of the riser segment assembly of FIG. 2.
Figure 5A:
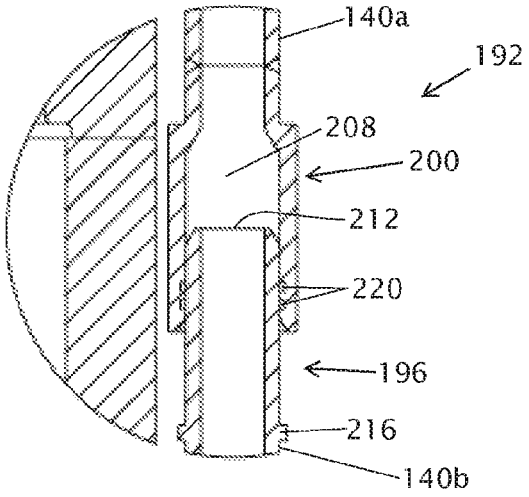
FIGS. 5A and 5B depict enlarged cross-sectional views of certain details of the riser segment assembly of FIG. 2, as indicated by regions 5A and 5B in FIG. 4.
Figure 5B:
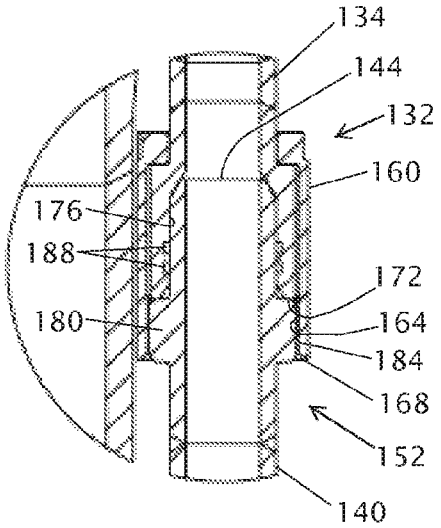

In the embodiment shown, body 140*c* includes a third connector 152*a* configured to be connected to first connector 132*a* (e.g., without welding), and a fourth connector 156*a* configured to be connected to second connector 136*a* (e.g., without welding). Rather than forming a threaded union, each pair of connectors (132*a* and 152*a*, 136*a* and 156*a*) forms a joint that is similar to a telescoping joint (e.g., joint 192 described above). More particularly, in the embodiment shown, connectors 132*a* and 136*a* are female connectors that include an enlarged end with a recess configured to slidably receive male connectors 152*a* and 156*a*, respectively. In this embodiment, connectors 132*a* and 136*a* are coupled to flanges 112*a* and 112*b* in similar fashion to connectors 132 and 136 of assembly 18. In particular, conduit 134*a* extends from connector 132*a* to (e.g., and is welded to) a female fitting 256 sized to fit within the corresponding one of auxiliary holes 124 of flange 112*a*, and conduit 138*a* extends from connector 136*a* (e.g., and is welded to) a male fitting 264 sized to fit within the corresponding one of auxiliary holes 124 in and extend beyond flange 112*b*, as shown in FIG. 4. In this embodiment, one of fittings 256 and 264 (e.g., male fitting 264) can be secured to the respective flange (e.g., 112*b*) and body 140*c* (e.g., end 148) can be inserted into the correspondingly secured connector (e.g., 136*a*). The other of the fittings (e.g., female fitting 256) can then be threaded or otherwise inserted into the respective auxiliary hole in the opposing flange (e.g., 112*a*) as the corresponding connector (e.g., 132*a*) receives the corresponding other end (e.g., end 144) of body 140*c*, and the other fitting (e.g., female fitting 256) can be secured to the respective flange (e.g., 112*a*).

In the embodiment shown, body 140*c* includes a medial portion 224*a* that is laterally offset from first and second ends 144*a* and 148*a*, as shown. For example, in the embodiment shown, main tube 100*a* includes an isolation unit 228*a* configured to substantially seal an annulus in main tube if a drill string is disposed in the main tube, such that medial portion 224*a* is configured to extend around isolation unit 228*a*. Isolation unit 228*a* may, for example, be similar in structure to a spherical or annular (or other type of) blowout preventer (BOP). In this embodiment, isolation unit 228*a* has an outer diameter of 59 inches and will, by itself, fit through a 60.5-inch rotary of a drilling rig. As mentioned above for isolation unit 228, isolation unit 228*a* can have various other outer diameters. Isolation unit 228*a* is included as an example of a component that may be included in the present riser segment assemblies; other embodiment may not include an isolation unit and/or may include other types of devices (e.g., a rotating control device), other types of BOPs, and/or the like). In this embodiment, the outer diameter of isolation unit 228*a* is greater than the outer diameter of flanges 112*a* and 112*b*, such that the lateral offset of medial portion 224*a* of body 140*c* relative to its ends permits body 140*c* (and thereby auxiliary line 128*a*) to extend around isolation unit 228. In other embodiment, body 140 may be axially aligned along its length (may not include a laterally offset portion).

However, in some embodiments (such as the one shown), rather than auxiliary lines 128*a* extending entirely around isolation unit 228*a*, the housing (232*a* and 240*a*) of the isolation unit includes a passage 300 configured to receive an auxiliary line 128*a* within a maximum transverse dimension 304 (e.g., diameter in the depicted embodiment) of the isolation unit. More particularly, in the embodiment shown, the housing (232*a* and 240*a*) of the isolation unit includes a plurality of passages 300, each configured to receive an auxiliary line (128*a*) within the maximum outer transverse dimension of the isolation unit, and a plurality of auxiliary lines 128*a* each disposed within and extending through one of the plurality of passages 300. In the embodiment shown, passages 300 include insets on the housing (232*a* and 240*a*) that extend inwardly from an outer perimeter 308 of isolation unit 228*a* to define open channels (that are laterally open to the exterior of the isolation unit. In other embodiments, passages 300 may include channels with closed cross-sections (bores) that extend through the housing of the isolation unit but are not laterally open to the exterior of the isolation unit.

Some embodiments of the present methods include lowering assembly 18*a* through a rotary 272 of a drilling rig (e.g., with assembly 18*a* connected to other riser segments).

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the devices are not intended to be limited to the particular forms disclosed. Rather, they include all modifications and alternatives falling within the scope of the claims, and embodiments other than the one shown may include some or all of the features of the depicted embodiment. For example, components may be omitted or combined as a unitary structure, and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A riser segment assembly comprising:

a first flange comprising: a first mating face configured to mate with an adjacent riser segment, a first end spaced apart from the first mating face, a first flange central lumen extending between the first mating face and the first end, and an auxiliary hole configured to receive an auxiliary line;

a first main tube having a first end, a second end, and a first main tube central lumen extending between the first end and the second end, the first end of the first main tube welded or threaded to the first end of the first flange such that the first main tube central lumen is in fluid communication with the first flange central lumen;

an isolation unit configured to seal an annulus in the riser segment assembly if a drill string is disposed in the riser segment assembly, the isolation unit comprising:

a housing with a maximum transverse dimension, the housing further comprising:

a first housing portion having a first end, a second end, a first housing portion central lumen extending between the first end and the second end, and a flange surrounding the first housing portion central lumen, the flange of the first housing portion defining a first recess extending radially inward from the maximum transverse dimension, the first end of the first housing portion welded or threaded to the second end of the first main tube such that the first housing portion central lumen is in fluid communication with the first main tube central lumen;

a second housing portion having a first end, a second end, a second housing portion central lumen extending between the first end and the second end, and a flange surrounding the second housing portion central lumen, the flange of the second housing portion defining a second recess extending radially inward from the maximum transverse dimension, the first end of the second housing portion coupled to the second end of the first housing portion such that the second housing portion central lumen is in fluid communication with the first housing portion central lumen;

where the first recess is aligned with the second recess to define a passage configured to receive within the maximum transverse dimension an auxiliary line passing through the flanges of the first and second housing portions;

a second main tube having a first end, a second end, and a second main tube central lumen extending between the first end and the second end, the first end of the second main tube welded or threaded to the second end of second housing portion such that the second main tube central lumen is in fluid communication with the second housing portion central lumen;

a second flange comprising: a second mating face configured to mate with an adjacent riser segment, a second end spaced apart from the second mating face, a second flange central lumen extending between the second mating face and the second end, and an auxiliary hole configured to receive an auxiliary line, the second end of the second flange welded or threaded to the second end of the second main tube such that the second flange central lumen is in fluid communication with the second main tube central lumen; and an auxiliary line having a first end coupled to the first flange, a second end coupled to the second flange, and a medial portion laterally offset from the first end of the first flange and the second end of the second flange and disposed in the passage.

2. The riser segment assembly of claim 1, where the isolation unit housing has a circular cross section and the maximum transverse dimension is the diameter of the circular cross-section.

3. The riser segment assembly of claim 1, where the auxiliary line comprises:

a first connector coupled to the first flange;

a second connector coupled to the second flange; and a body having a first end configured to be slidably received in the first connector, and a second end configured to be slidably receive the second connector.

4. The riser segment assembly of claim 1, where the flange of the first housing portion defines a plurality of first recesses each extending radially inward from the maximum transverse dimension, the flange of the second housing portion defining a plurality of second recesses each extending radially inward from the maximum transverse dimension, where each of the first recesses is aligned with a different one of the second recesses to define a plurality of passages each configured to receive within the maximum transverse dimension one of a plurality of auxiliary lines passing through the flanges of the first and second housing portions.

5. The riser segment assembly of claim 4, further comprising:

a plurality of auxiliary lines each having a first end coupled to the first flange, a second end coupled to the second flange, and a medial portion laterally offset from the first end of the first flange and the second end of the second flange and disposed in one of the passages.

6. The riser segment assembly of claim 5, where at least one of the auxiliary lines includes a first line portion coupled to the first flange, and a second line portion coupled to the second flange and removably coupled to the first line portion, where the second line portion is configured to be separated from the first line portion if the second housing portion is separated from the first housing portion.

7. The riser segment assembly of claim 6, where the second line portion is removably coupled to the first line portion via a telescoping joint.

8. The riser segment assembly of claim 5, where each auxiliary line comprises:

a first connector coupled to the first flange;

a second connector coupled to the second flange; and a body having a first end configured to be slidably received in the first connector, and a second end configured to be slidably receive the second connector.

9. The riser segment assembly of claim 5, where the offset portions of all of the auxiliary line fits within a circle having a diameter no larger than 150% of a maximum transverse dimension of either of the first and second flanges.

10. The riser segment assembly of claim 9, where the offset portions of all of the auxiliary line fits within a circle having a diameter no larger than 120% of the maximum transverse dimension of either of the first and second flanges.

11. The riser segment assembly of claim 10, where the offset portions of all of the auxiliary line fits within a circle having a diameter no larger than the maximum transverse dimension of either of the first and second flanges.

12. The riser segment assembly of claim 5, where the plurality of auxiliary lines includes at least one booster line and at least one choke/kill line.

13. The riser segment assembly of claim 1, where the isolation unit housing has a circular cross section and the maximum transverse dimension is the diameter of the circular cross-section.

14. The riser segment assembly of claim 1, where the second housing portion is releasably coupled to the first housing portion to define an inner chamber configured to receive an annular sealing element encircling the first housing portion central lumen and second housing portion central lumen.

15. The riser segment assembly of claim 14, where the maximum transverse dimension is smaller than 60.5 inches.

16. A method comprising:

lowering a riser segment assembly of claim 1 through a rotary of a drilling rig.

17. A riser segment assembly comprising:

a first flange comprising: a first mating face configured to mate with an adjacent riser segment, a first end spaced apart from the first mating face, a first flange central lumen extending between the first mating face and the first end, and an auxiliary hole configured to receive an auxiliary line;

a first main tube having a first end, a second end, and a first main tube central lumen extending between the first end and the second end, the first end of the first main tube welded or threaded to the first end of the first flange such that the first main tube central lumen is in fluid communication with the first flange central lumen;

an equipment component comprising:

a component housing with a maximum transverse dimension, the housing further comprising:

a first housing portion having a first end, a second end, a first housing portion central lumen extending between the first end and the second end, and a flange surrounding the first housing portion central lumen, the flange of the first housing portion defining a first recess extending radially inward from the maximum transverse dimension, the first end of the first housing portion welded or threaded to the second end of the first main tube such that the first housing portion central lumen is in fluid communication with the first main tube central lumen;

a second housing portion having a first end, a second end, a second housing portion central lumen extending between the first end and the second end, and a flange surrounding the second housing portion central lumen, the flange of the second housing portion defining a second recess extending radially inward from the maximum transverse dimension, the first end of the second housing portion coupled to the second end of the first housing portion such that the second housing portion central lumen is in fluid communication with the first housing portion central lumen;

where the first recess is aligned with the second recess to define a passage configured to receive within the maximum transverse dimension an auxiliary line passing through the flanges of the first and second housing portions;

a second main tube having a first end, a second end, and a second main tube central lumen extending between the first end and the second end, the first end of the second main tube welded or threaded to the second end of second housing portion such that the second main tube central lumen is in fluid communication with the second housing portion central lumen;

a second flange comprising: a second mating face configured to mate with an adjacent riser segment, a second end spaced apart from the second mating face, a second flange central lumen extending between the second mating face and the second end, and an auxiliary hole configured to receive an auxiliary line, the second end of the second flange welded or threaded to the second end of the second main tube such that the second flange central lumen is in fluid communication with the second main tube central lumen; and an auxiliary line having a first end coupled to the first flange, a second end coupled to the second flange, and a medial portion laterally offset from the first end of the first flange and the second end of the second flange and disposed in the passage.

18. The riser segment assembly of claim 17, where the component housing has a circular cross section and the maximum transverse dimension is the diameter of the circular cross-section.

19. The riser segment assembly of claim 17, where the flange of the first housing portion defines a plurality of first recesses each extending radially inward from the maximum transverse dimension, the flange of the second housing portion defining a plurality of second recesses each extending radially inward from the maximum transverse dimension, where each of the first recesses is aligned with a different one of the second recesses to define a plurality of passages each configured to receive within the maximum transverse dimension one of a plurality of auxiliary lines passing through the flanges of the first and second housing portions.

20. The riser segment assembly of claim 19, further comprising:

a plurality of auxiliary lines each having a first end coupled to the first flange, a second end coupled to the second flange, and a medial portion laterally offset from the first end of the first flange and the second end of the second flange and disposed in one of the passages.

21. The riser segment assembly of claim 20, where each auxiliary line comprises:

a first connector coupled to the first flange;

a second connector coupled to the second flange; and a body having a first end configured to be slidably received in the first connector, and a second end configured to be slidably receive the second connector.

22. The riser segment assembly of claim 19, where at least one of the auxiliary lines includes a first line portion coupled to the first flange, and a second line portion coupled to the second flange and removably coupled to the first line portion, where the second line portion is configured to be separated from the first line portion if the second housing portion is separated from the first housing portion.

23. The riser segment assembly of claim 22, where the second line portion is removably coupled to the first line portion via a telescoping joint.

24. The riser segment assembly of claim 17, where the component housing has a circular cross section and the maximum transverse dimension is the diameter of the circular cross-section.

25. The riser segment assembly of claim 17, where the maximum transverse dimension is smaller than 60.5 inches.

26. A method comprising:

lowering a riser segment assembly of claim 17 through a rotary of a drilling rig.

* * * * *